US007815263B1

(12) United States Patent
Wright

(10) Patent No.: US 7,815,263 B1
(45) Date of Patent: Oct. 19, 2010

(54) CANDLE BOX

(76) Inventor: Sandradee N. Wright, 2761 Winding Creek La., Greenfield, IN (US) 46140

( * ) Notice: Subject to any disclaimer, the term of this patent is extended or adjusted under 35 U.S.C. 154(b) by 261 days.

(21) Appl. No.: 12/188,078

(22) Filed: Aug. 7, 2008

(51) Int. Cl.
*A47B 97/00* (2006.01)

(52) U.S. Cl. ..... 312/204; 312/290

(58) Field of Classification Search ..... 312/204, 312/290, 283, 216, 107, 109, 114, 117
See application file for complete search history.

(56) References Cited

U.S. PATENT DOCUMENTS

| | | | | | |
|---|---|---|---|---|---|
| 1,164,024 | A | * | 12/1915 | Smith et al. | 312/204 |
| D140,507 | S | * | 3/1945 | Kuchta | D6/397 |
| 2,486,517 | A | * | 11/1949 | Casali | 312/204 |
| 3,001,638 | A | * | 9/1961 | Kuzmich | 312/244 |
| 3,268,282 | A | * | 8/1966 | Harvey | 312/204 |
| 3,360,317 | A | * | 12/1967 | Maclennan | 312/204 |
| 5,154,600 | A | * | 10/1992 | Sylvestre | 431/253 |
| 5,303,057 | A | * | 4/1994 | Davidow et al. | 312/205 |
| D388,884 | S | | 1/1998 | Karnoski | |
| D407,577 | S | * | 4/1999 | Dorst | D6/434 |
| D410,346 | S | * | 6/1999 | Kerr | D6/397 |
| 5,941,046 | A | | 8/1999 | Prather | |
| D423,810 | S | * | 5/2000 | Dorst | D6/397 |
| 6,148,584 | A | | 11/2000 | Wilson | |
| 6,173,542 | B1 | | 1/2001 | Wright | |
| 6,647,679 | B2 | | 11/2003 | Belleau | |
| 6,807,783 | B2 | | 10/2004 | Lee | |
| 7,228,663 | B2 | | 6/2007 | Schiedegger et al. | |
| 2002/0185410 | A1 | * | 12/2002 | Travis-Pence | 206/736 |

FOREIGN PATENT DOCUMENTS

JP 2006288421 A * 10/2006

* cited by examiner

*Primary Examiner*—Hanh V Tran

(57) ABSTRACT

A candle box for displaying a variety of themes and for safely burning items such as a candle comprising a top panel, a bottom panel, a first side panel, a second side panel, and a back panel. A front panel is removably attached to the first side panel and the second side panel. Attached to the first side panel and the second side panel is a first trim component and a second trim component, wherein the trim components are for covering a storage compartment disposed in the first side panel and the second side panel.

5 Claims, 5 Drawing Sheets

CANDLE BOX

FIELD OF THE INVENTION

The present invention is directed to a box for holding and safely burning candles and the like. More particularly, the present invention is directed to a candle box with removable and interchangeable pieces.

BACKGROUND OF THE INVENTION

The present invention features a candle box for safely burning items (e.g., candles, incense) and for displaying a variety of themes. The candle box comprises a top panel, a bottom panel, a first side panel, a second side panel, and a back panel. A storage compartment is disposed in the first side panel, the second side panel, and the top panel. The storage compartment functions to store items such as a candle, matches, incense, the like, or a combination thereof. The candle box further comprises a front panel removably attached to the first side panel and the second side panel via a tool-free attachment means. A first trim component is removably attached to the first side panel via a tool-free attachment means, and a second trim component is removably attached to the front face of the second side panel via a tool-free attachment means. The first trim component, the second trim component, and the front panel are removable and can be replaced with different first trim components, second trim components, and front panels, respectively.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
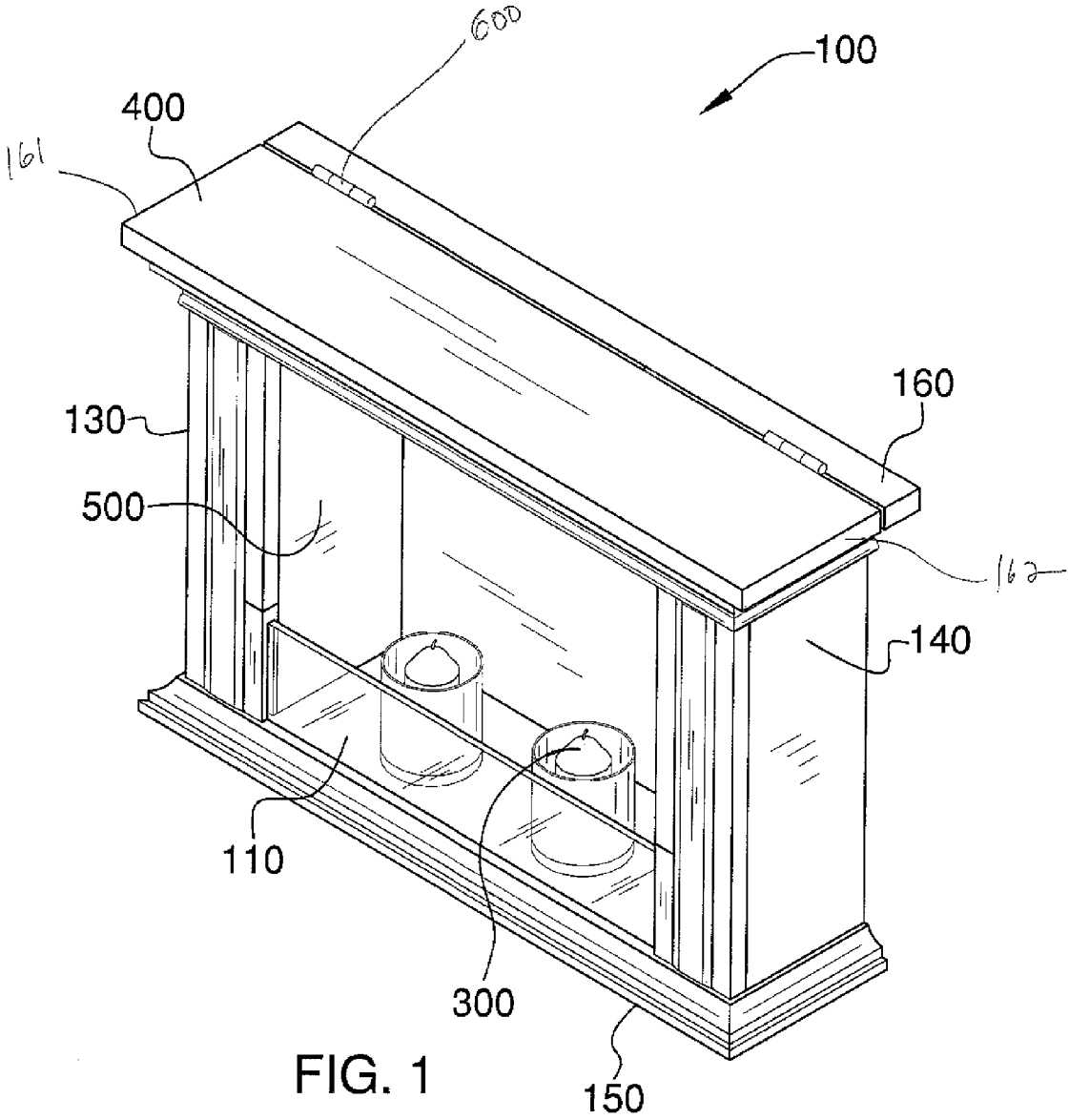
FIG. 1 is a perspective view of the candle box of the present invention.

The following is a listing of numbers corresponding to a particular element refer to herein:

100 candle box
110 front panel
111 first end of front panel
112 second end of second panel
120 back panel
130 first side panel
131 front face of first side panel

Figure 2:
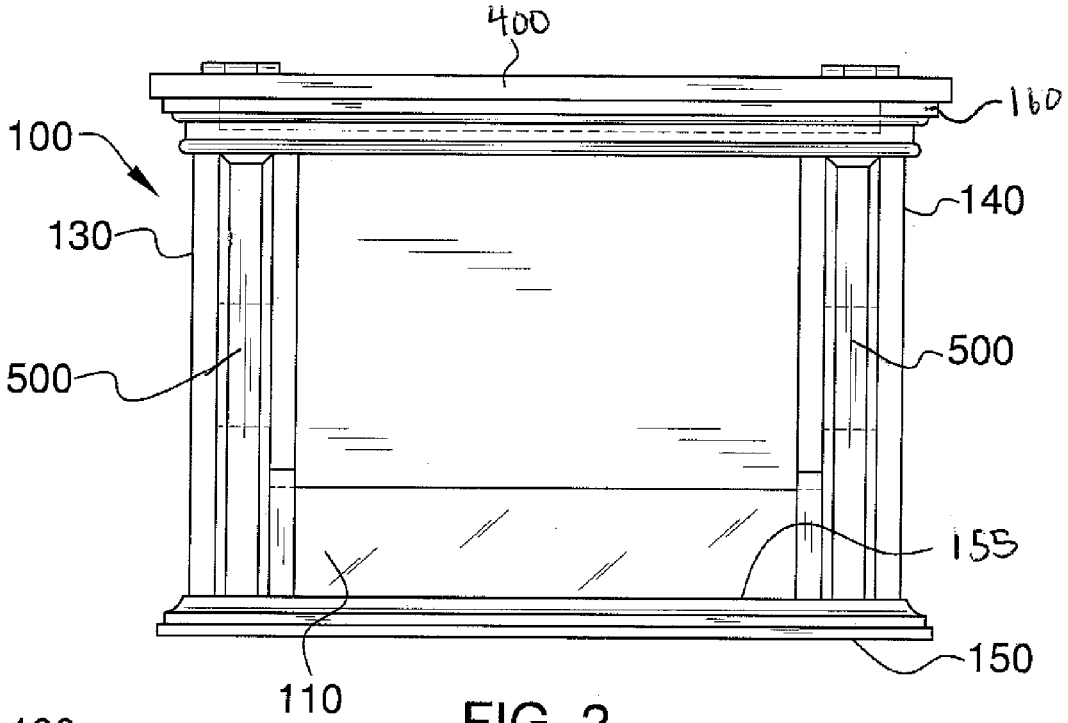
FIG. 2 is a front view of the candle box of the present invention.
Figure 3:
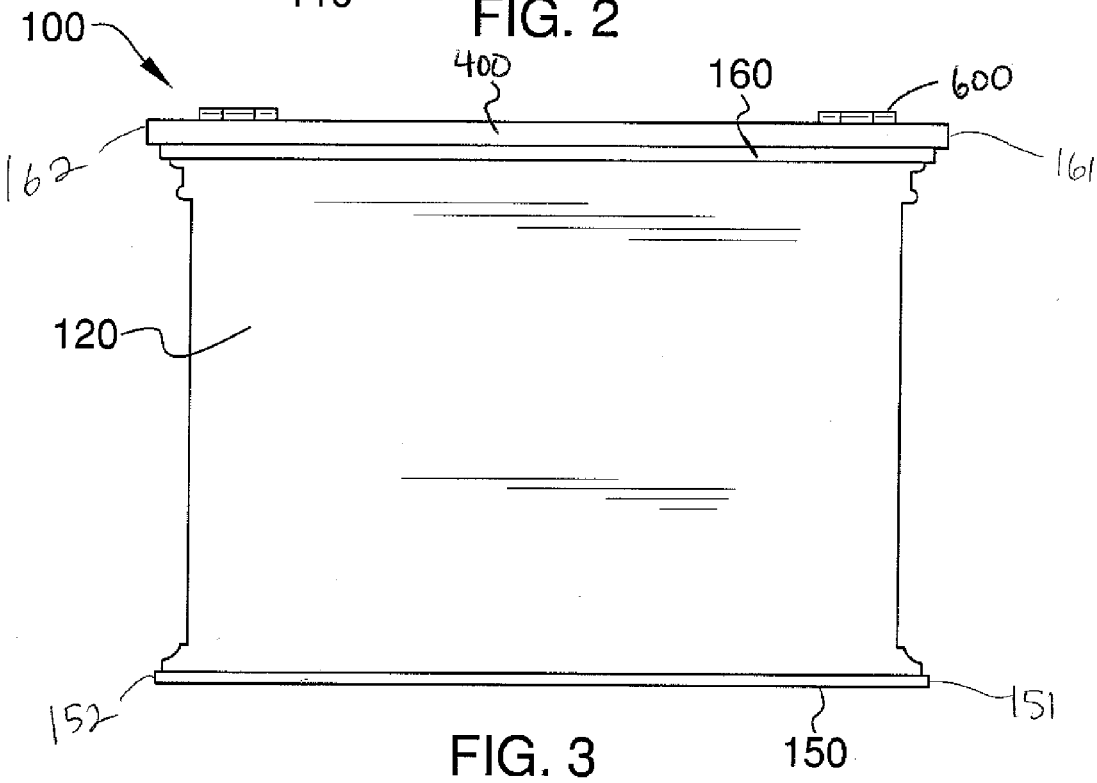
FIG. 3 is a back view of the candle box of the present invention.
Figure 4:
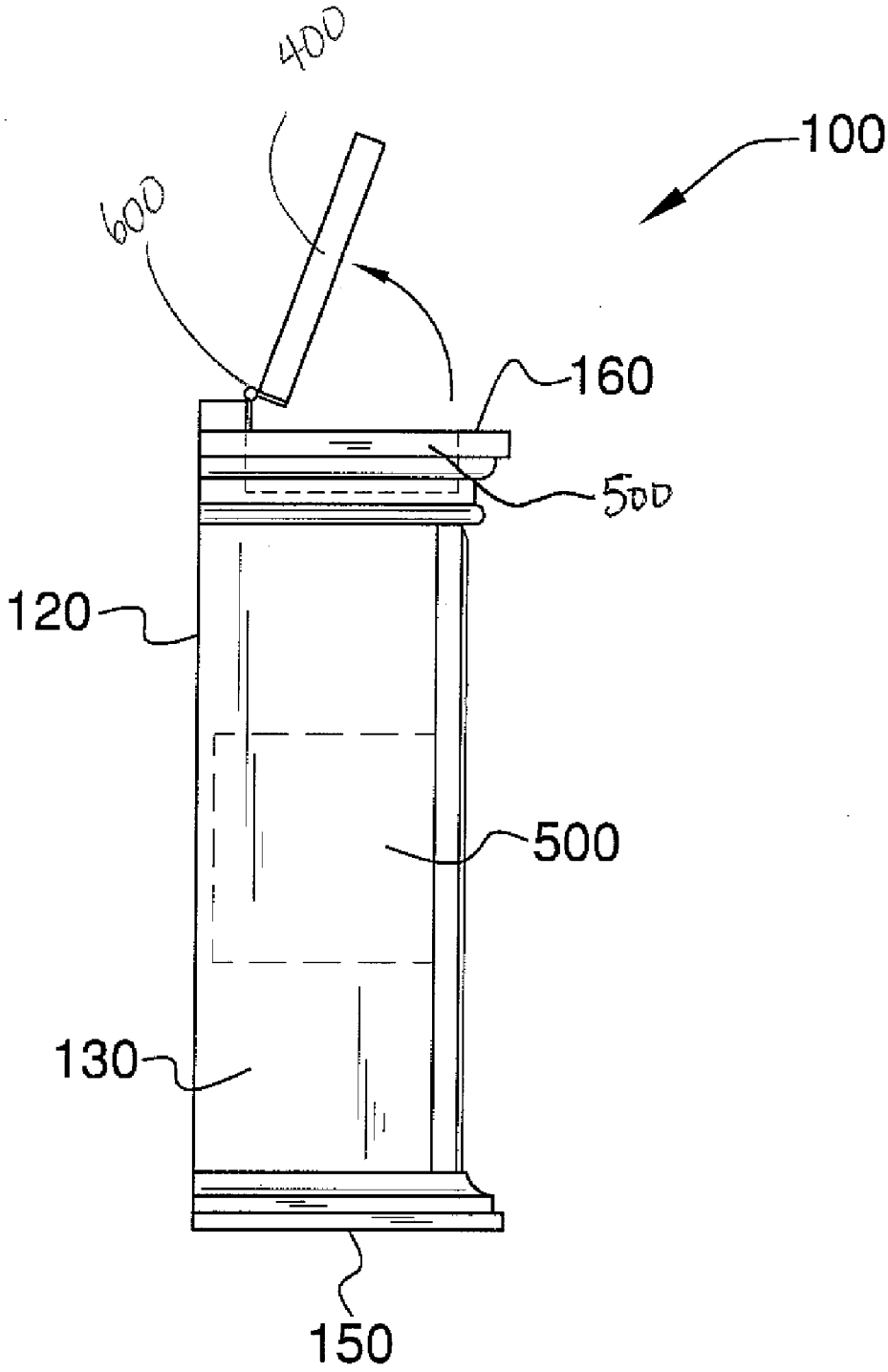
FIG. 4 is a side view of the candle box of the present invention.
Figure 5:
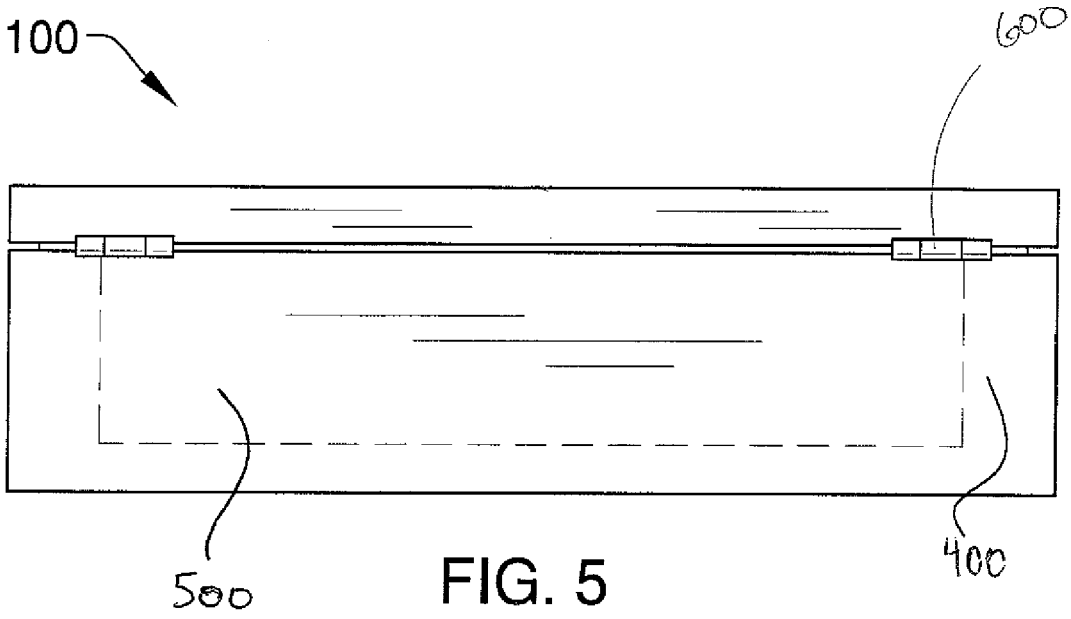
FIG. 5 is a top view of the candle box of the present invention.
Figure 6:
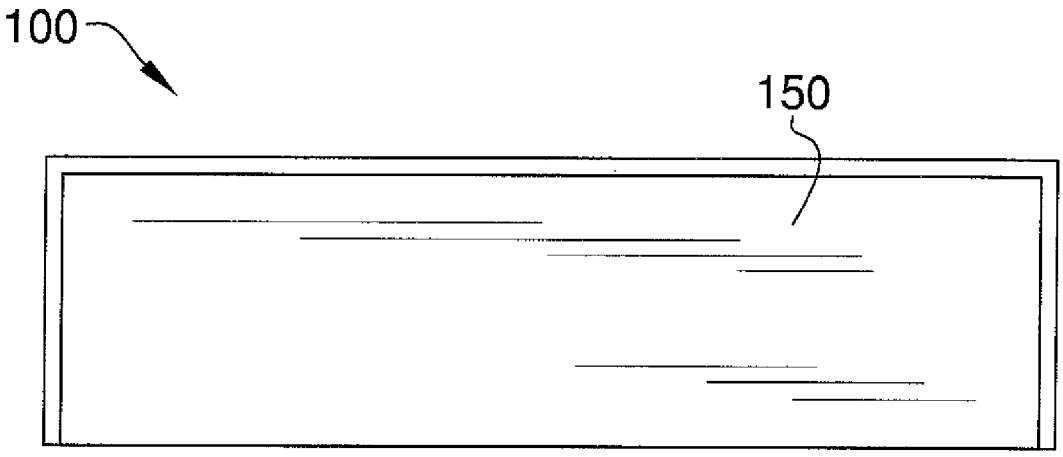
FIG. 6 is a bottom view of the candle box of the present invention.
Figure 7:
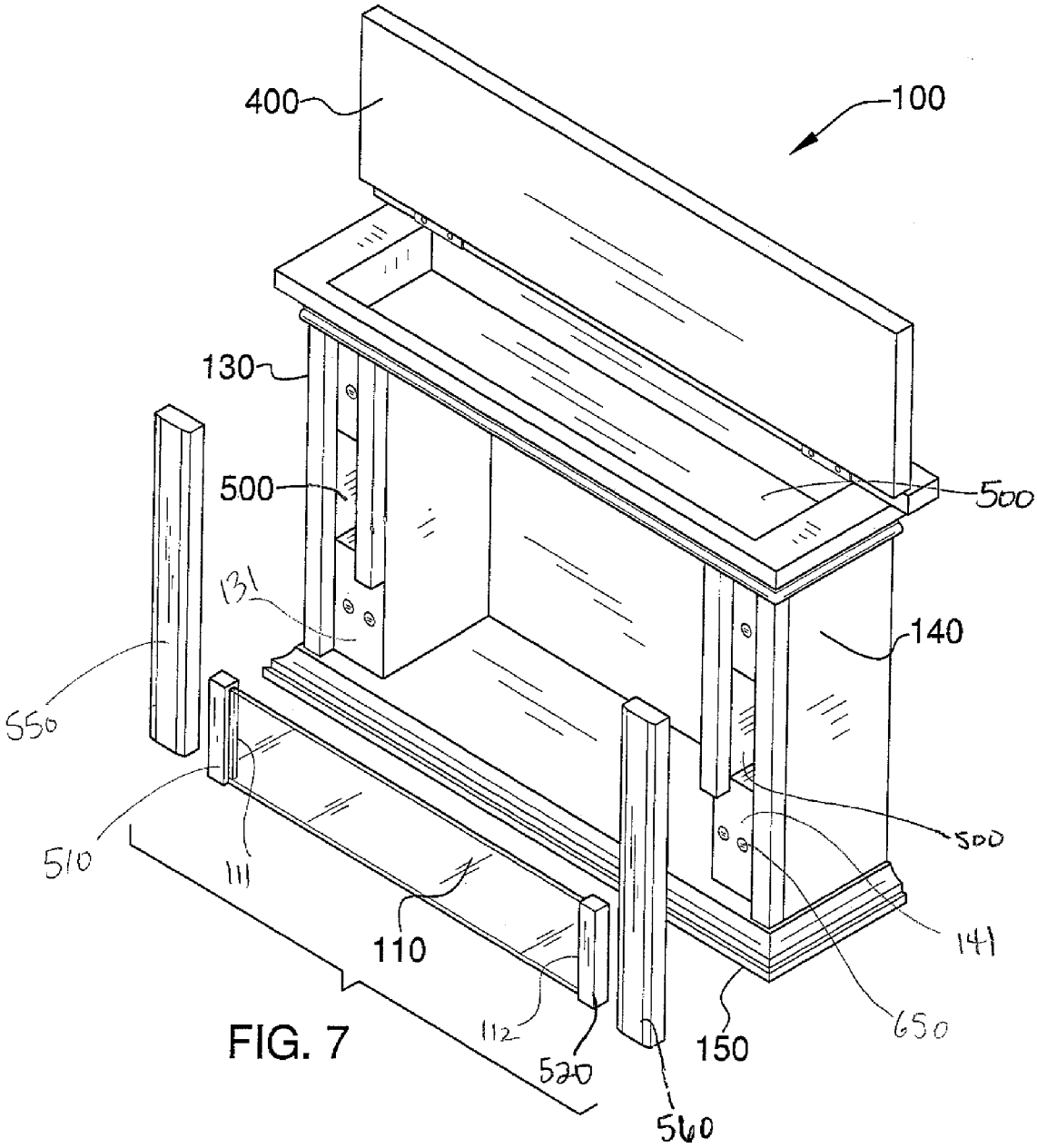
FIG. 7 is an exploded view of the components of the candle box of the present invention.

140 second side panel
141 front face of second side panel
150 bottom panel
151 first end of bottom panel
152 second end of bottom panel
155 top surface of bottom panel
160 top panel
161 first end of top panel
162 second end of top panel
300 candle
400 lid
500 storage compartment
510 first wing
520 second wing
550 first trim component
560 second trim component
600 hinge
650 magnet Referring now to FIGS. 1-6, the present invention features a candle box for safely burning items (e.g., candles, incense) and for storing items. The candle box can also function to display a variety of themes.

The candle box comprises a top panel having a first end, a second end, a top surface, and a bottom surface; a bottom panel having a first end, a second end, and a top surface; a first side panel having a front face; a second side panel having a front face; and a back panel. The first side panel is vertically connected to the top panel at the first end and vertically connected to the bottom panel at the first end. The second side panel is vertically connected to the top panel at the second end and vertically connected to the bottom panel at the second end.

A storage compartment is disposed in the first side panel, the second side panel, and the top panel, wherein the storage compartment functions to store items such as a candle, matches, incense, the like, or a combination thereof. A lid is attached to the top surface of the top panel via a hinge, wherein the lid functions to cover the storage compartment disposed in the top panel.

The candle box further comprises a front panel having a first end and a second end, wherein a first wing is attached to the first end and a second wing is attached to the second end. The first wing of the front panel is removably attached to the front face of the first side panel via a tool-free attachment means, and the second wing of the front panel is removably attached to the front face of the second side panel via a tool-free attachment means.

A first trim component is removably attached to the front face of the first side panel via a tool-free attachment means. The first trim component is for covering the storage compartment disposed in the first side panel. A second trim component is removably attached to the front face of the second side panel via a tool-free attachment means. The second trim component is for covering the storage compartment disposed in the second side panel.

In some embodiments, a tool-free attachment means includes a magnet mechanism, a hook-and-loop mechanism, a snap mechanism, a dowel mechanism, the like, or a combination thereof.

In some embodiments, the storage compartment functions to store other front panels, first trim components, and/or second trim components.

In some embodiments, the candle box functions to replace a fireplace. In some embodiments, a candle can be placed on the top surface of the bottom panel. In some embodiments, the candle box is easily transportable to a variety of locations (e.g., bedroom, bathroom, living room, kitchen, porch, the like).

As used herein, the term "interchangeable" refers to removable, replaceable, and/or interchangeable. For example, an embodiment wherein the front panel is interchangeable refers to a front panel that can be removed and replaced with a different front panel. An important feature of the present invention is that the front panel, the first trim component, and the second trim component are interchangeable (e.g., removable).

In some embodiments, a user may replace the front panel, the first trim component, and/or the second trim component with another front panel, first trim component, and second trim component, respectively.

In some embodiments, the front panel, the first trim component, and the second trim component function to decorate the candle box and present a variety of themes. In some embodiments, the variety of themes includes a color scheme, a holiday theme (Christmas, Thanksgiving, Independence Day, Halloween, etc.), a birthday theme, a design scheme, the like, or a combination thereof. In some embodiments, a user can decorate the front panel, the first trim component, and/or the second trim component. In some embodiments, the front panel, the first trim component, and/or the second trim component can be personalized.

The candle box is constructed from a material comprising a fire retardant material. In some embodiments, the candle box is constructed from a material comprising wood, tile, stone, glass (e.g., solid glass, stained glass), and metal (e.g., metal grate/face, metal mesh curtain). In some embodiments, the front panel is constructed from a material comprising glass to allow a user to view a candle disposed on the top surface of the bottom panel of the candle box.

The candle box allows for safely burning items because it is constructed from a material comprising a fire retardant material. For example, in some embodiments, a fire retardant material includes a sand and/or cement material (e.g., Super 3000 Cement™). In some embodiments, the fire retardant material withstands temperatures up to 3000 degrees Fahrenheit.

As used herein, the term "about" refers to plus or minus 10% of the referenced number. For example, an embodiment wherein the candle box is about 20 inches tall includes a storage box that is between 18-22 inches tall.

The candle box may be constructed in a variety of sizes. For example, in some embodiments, the candle box is between about 10 to 38 inches tall as measured from the top panel to the bottom panel. In some embodiments, the candle box is between about 15.25 inches tall as measured from the top panel to the bottom panel.

In some embodiments, the candle box is about 10 to 48 inches wide as measured from the first side panel to the second side panel. In some embodiments, the candle box is about 18.5 inches wide as measured from the first side panel to the second side panel.

In some embodiments, the candle box is about 4 to 18 inches thick as measured from the front panel to the back panel. In some embodiments, the candle box is about 5.25 inches thick as measured from the front panel to the back panel.

In some embodiments, the candle box is about 12 inches tall, and a storage component is disposed in the first side panel and/or the second side panel about 4 inches above the bottom panel and about 4 inches below the bottom panel. In some embodiments, a storage compartment is disposed in the top panel.

The following the disclosures of the following U.S. Patents are incorporated in their entirety by reference herein: U.S. Pat. No. 6,807,783 B2; U.S. Pat. No. 6,647,679 B2; U.S. Pat. No. 6,173,542 B1; U.S. Pat. No. 6,148,584; U.S. Pat. No. 7,228,663 B2; U.S. Pat. No. 5,941,046.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A candle box for presenting a variety of themes and safely burning a candle, said candle box comprising:

(a) a top panel having a first end, a second end, a top surface, and a bottom surface; a bottom panel having a first end, a second end, and a top surface; a first side panel having a front face, said first side panel vertically connected to the top panel at the first end and vertically connected to the bottom panel at the first end; a second side panel having a front face, said second side panel vertically connected to the top panel at the second end and vertically connected to the bottom panel at the second end; and a back face;

(b) a storage compartment disposed in each of the first side panel, the second side panel, and the top panel, wherein the storage compartment functions to store items;

(c) a lid attached to the top surface of the top panel via a hinge, wherein the lid functions to cover the storage compartment disposed in the top panel;

(d) a front panel having a first end and a second end, a top edge and a bottom edge, wherein a first wing is attached to the first end and a second wing is attached to the second end; wherein the first wing of the front panel is removably attached to the front face of the first side panel via a tool-free attachment means, wherein the second wing of the front panel is removably attached to the front face of the second side panel via a tool-free attachment means; and the bottom edge is supported on the top surface of the bottom panel, (e) a first trim component removably attached to the front face of the first side panel via a tool-free attachment means, wherein the first trim component is for covering the storage compartment disposed in the first side panel; and (f) a second trim component removably attached to the front face of the second side panel via a tool-free attachment means, wherein the second trim component is for covering the storage compartment disposed in the second side panel;

wherein the candle box is constructed from a material comprising a fire retardant material; wherein the first trim component, the second trim component, and the front panel are removable and can be replaced with a different first trim component, second trim component, and front panel, respectively; wherein a candle can be placed on the top surface of the bottom panel.

2. The candle box of claim 1, wherein the variety of themes includes a color scheme, a holiday theme, a birthday theme, a design scheme, or a combination thereof.

3. The candle box of claim 1, wherein the tool-free attachment means includes a magnet mechanism, a hook-and-loop mechanism, a snap mechanism, a dowel mechanism, or a combination thereof.

4. The candle box of claim 1, wherein the candle box functions to replace a fireplace.

5. The candle box of claim 1, wherein the front panel is constructed from a material comprising glass to allow a user to view a candle disposed on the top surface of the bottom panel of the candle box.

* * * * *